United States Patent [19]

Rhoades et al.

[11] Patent Number: 4,681,600

[45] Date of Patent: Jul. 21, 1987

[54] CUTTING TOOL FABRICATION PROCESS

[75] Inventors: Lawrence J. Rhoades; William D. Jenkins, both of Pittsburgh; David D. Pertle, Irwin, all of Pa.

[73] Assignee: Extrude Hone Corporation, Irwin, Pa.

[21] Appl. No.: 776,652

[22] Filed: Sep. 16, 1985

Related U.S. Application Data

[63] Continuation of Ser. No. 647,532, Sep. 5, 1984.

[51] Int. Cl.[4] ..... B24D 3/00

[52] U.S. Cl. ..... 51/293; 51/295; 51/298

[58] Field of Search ..... 51/293, 298, 295

[56] References Cited

U.S. PATENT DOCUMENTS

| | | | |
|---|---|---|---|
| 2,014,955 | 9/1935 | Taylor | 76/108 R |
| 3,625,666 | 6/1969 | James | 51/295 |
| 3,864,101 | 2/1975 | Charvat | 51/293 |
| 4,539,017 | 9/1985 | Augustin | 51/293 |
| 4,541,843 | 9/1985 | Elbel et al. | 51/293 |
| 4,560,586 | 12/1985 | Tölle et al. | 51/298 |
| 4,561,863 | 12/1985 | Hashimoto et al. | 51/298 |

*Primary Examiner*—Paul Lieberman
*Assistant Examiner*—Willie J. Thompson
*Attorney, Agent, or Firm*—James S. Waldron

[57] ABSTRACT

A method is provided for making improved molded abrasive tools by applying centifugal force and/or vibratory action to the abrasive particles during the molding operation. The abrasive is thereby forced and/or sifted preferentially into a closely packed surface layer with close conformity to the mold surface.

13 Claims, 4 Drawing Figures

CUTTING TOOL FABRICATION PROCESS

This is a continuation of co-pending application Ser. No. 647,532 filed Sept. 5, 1984.

FIELD OF THE INVENTION

This invention relates to cutting tools generally, and in particular to the fabrication of abrasive-faced cutting tools having utility in the abradant machining of materials by such techniques as grinding and lapping, whereby stock may be abradantly removed to form a desired surface profile. The present invention further relates especially to a process for the fabrication of abrasive-faced cutting tools having compound cutting faces, and to cutting tools produced in accordance therewith.

BACKGROUND OF THE INVENTION

Various types of abrasive cutting tools are known in the art, and in general their fabrication depends in large part upon their intended application and upon the abrasive employed.

For example, in general grinding applications, where it is desired to remove stock from a workpiece, a cutting tool such as a grinding wheel may be mounted for rotational movement upon a machine spindle, and abrading is then achieved by bringing the workpiece into contact with the abrasive-containing periphery of the rotating wheel, or vice versa. Known abrasive grinding wheels are typically fabricated by compounding abrasive material with a binder, (along with various additives and coatings where, for particular applications these are required) and this compound is then cast or molded with heat and/or pressure being applied to bring about bonding of the compounded materials by setting of the binder, as by sintering or curing, or the like. Often such grinding wheels are fabricated of vitreous materials such as glass or ceramic frits and the like. A characteristic common to grinding wheels is that they are typically of homogenous composition, i.e., their abrasive(s) are dispersed throughout the wheel, and thus they may be used for extended periods until they become worn down to the attachment hub. The abrading surface of a grinding wheel typically requires occasional dressing back to the required grinding profile, and this is usually achieved by the application of a dressing tool having a hardness greater than that of the abrasive material of the wheel.

Because of their homogenous dispersion of abrasives, grinding wheels generally offer desirable economies of fabrication and operation and, as noted, have considerable service life with periodic dressing. Such economies, however, are obviated where, due to the hard nature of the material to be abraded or because an extremely fine surface finish is to be produced, it is necessary to compound such wheels with more exotic abrasive materials, such as diamonds or diamond-containing abrasives. Also, where frequent close-tolerance redressing to a particular profile is necessary, the labor and time required by the dressing operation alone with the concomitant machine "downtime" often obviates any other factors of economy.

Therefore it is often desirable to provide abrasive cutting tools which have abrasive-faced cutting surfaces, such as the diamond-faced drill disclosed by Taylor in U.S. Pat. No. 2,014,955 which has a number of diamonds embedded into the face of a molded, pressed and sintered tool. A disadvantage posed in practicing the method as taught by Taylor concerns the manual insertion of individual diamonds into a curved mold in which a thin layer of a plastic mixture has first been spread. As taught by Taylor, when employing diamonds large enough to be handled separately, these diamonds are pushed into and through this pasty plastic mixture layer until they come into contact with the mold surface in order to assure that the cutting point of each diamond will lie in the curved surface defined by the mold's cross-sectional curvative (i.e., at the cutting face), and so that no diamond will be above or below the zone of contact between the nose of the drill and the material being drilled. As further taught by Taylor, when employing diamonds too small to be handled separately and positioned in the thin plastic layer with tweezers, then these small diamonds may be poured onto the plastic layer into which the diamonds will sink under gravity to an extent which will provide a single layer of diamonds in the finished drill.

It becomes evident in practicing the method taught by Taylor for fabricating diamond-faced tools that such method is both labor intensive and imprecise in that the larger diamonds must be manually placed in the mold where their final orientation is dependent upon the retentive properties of the thin plastic matrix layer and subject to undesirable displacement during subsequent charging of the mold. When pouring smaller diamonds into the plastic mixture layer, it is critical that the consistency of the plastic mixture be such as to permit the diamonds to sink therethrough readily while thereafter retaining the diamonds therein when the mold is inverted to remove the diamonds which are not in contact with the paste layer. And in the latter case it becomes difficult to control or determine the proper placement of the diamond layer at the cutting face when the mold's cross-section is curved because the diamonds will tend to gravitate, or settle out, to the lowest portion of the mold and thus leave the upper surfaces of the cutting face unclad.

James, in the U.S. Pat. No. 3,625,666, teaches a method of forming metal-coated diamond abrasive wheels whereby diamond particles, having first been coated with nickel, are charged, in a fluid epoxy resin mixture, into a mold, and where settling out of the diamonds is prevented and the distribution of the particles in the fluid resin composition is controlled by applying a magnetic or electrostatic field across the mold. The direction of the lines of the applied field force is chosen to be normal to the eventual working face of the wheel so that the elongated diamond particles tend to align themselves axially along the lines of applied force. The applied field is maintained until the epoxy resin hardens. James further teaches the provision of asperities (e.g., ribs, raised screw threads, knurls, cones) in opposed faces of the mold cavity whereby, the applied field may be concentrated more strongly along certain lines therebetween so as to cause the diamond particles to arrange and align themselves between pairs of opposing asperities having opposite polarity.

Diamond wheels fabricated according to James offer the advantage of better distribution of the diamonds through the expoxy binder matrix as well as controlled orientation of their cutting faces, but present also the disadvantage that because the diamonds are distributed throughout the body of the tool rather than at its working face, this particular fabrication method is overly costly as it necessitates the use of more diamond material than in tools where the diamond abrasive is present only at the working tool face.

James further suggests forming the diamond-containing abrasive body as a separate element which, after forming, may be then applied to an appropriate base. Molding of resin-bonded diamond abrasive bodies is taught also by U.S. Pat. No. 4,246,004 to Busch et al., and the method therein proposed is applicable as well to the fabrication of abrasive bodies containing other abrasive materials than diamonds, so long as the abrasive particles employed are "needle shaped." The abrasive body disclosed by Busch et al., is a curved segment, a plurality of which may be bonded to a hub to provide a cup grinding wheel. As in the method of James, Busch et al., teach coating the "needle shaped" abrasive particles and during molding of the segment a magnetic field is induced directionally across the mold whereby the "needle shaped" abrasive particles tend to orientate with the long axes parallel with the lines of applied field force so that in the assembled cup grinding wheel their cutting faces are normal to the working face of the tool. But as with James' method, abrasive bodies fabricated in accordance with the method of Busch et al. necessitates using more diamond material than in tools where diamond abrasive is present only at the tool face, and further, the latter method requires that "needle shaped" abrasive particles be selected from batches of abrasive material, which further complicates fabrication and adds undesirably to the cost of fabricating abrasive tools.

Phaal, in U.S. Pat. No. 4,203,732 suggests a method for molding an abrasive grinding wheel rim having "needle shaped" abrasive particles whereby a mixture of abrasive particles and a resin bonding matrix is made to flow through the constricted passages of a mold thus causing the abrasive particles to orient with their long axes substantially in the direction of flow, whereafter the mixture is allowed to set. While the orientation method proposed by Phaal does not require using nickel-coated abrasive particles with an external energy field, it still suffers from the disadvantages that tools produced thereby will be more costly than tools having abrasive material such as diamonds present only at the working tool face, and suffers as well from the necessity of additional fabricating steps, and cost, of attaching the formed abrasive body to a suitable carrier in order to provide a usable tool.

Thus, from an economic standpoint alone, it is desirable, especially for profile machinery, to provide a tool which may be fabricated with an abrasive facing only at its working face(s), the remainder of the tool being constructed from easily formed and less expensive materials.

In certain abrasive machining operations, such as in the fabrication of graphite electrodes for use in electrochemical machining, a profiled form must be created which corresponds to the configuration of the object to be formed by the electrochemical machining operation such as in the case of a die cavity. It is known, for "total form machining", to employ an abrasive electrode form having a shape which is the reverse or mirror image of an electrode to be produced and which is constructed of abrasive particles held in a plastic matrix whereby an electrode may be abraded from electrode material (e.g., graphite) on movement of the electrode form with respect to the electrode material, as exemplified by U.S. Pat. Nos. 3,663,786 and 3,948,620.

SUMMARY OF THE INVENTION

The present invention is based upon the realization that a tool can be formed such that the distribution and alignment of abrasive particles at the working face of the tool can be improved substantially by molding such a tool in a cavity mold under the influence of centrifugal force and/or vibratory action.

DETAILED DESCRIPTION

Figure 1:
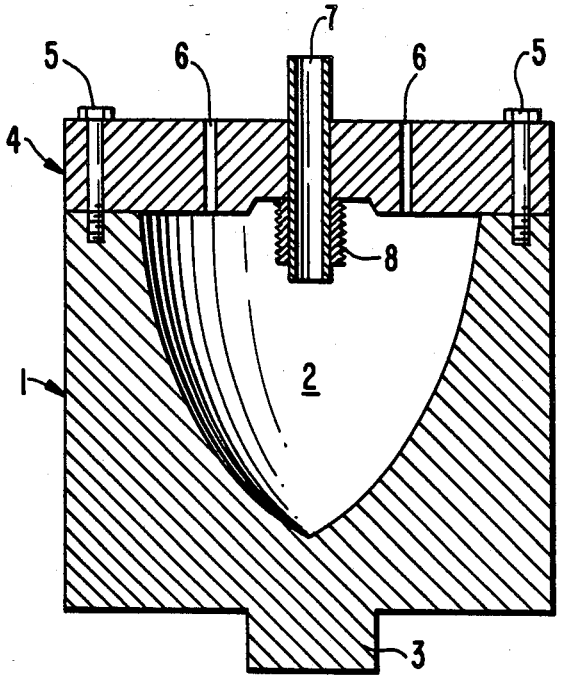
FIG. 1 shows a cross-sectional view of a tool forming mold adapted for use in imparting centrifugal force according to the present invention.

The procedure of the present invention can be adapted to substantially any tool forming operation based upon molding of particulate abrasives in a settable binder matrix. The forming operation can be supplemented by other procedures which are intended to achieve the same or similar objectives, wherein the mutual cooperation which results may be expected to provide superior abrasive tools.

The procedure employed in the present invention can be employed with any particulate abrasive and with substantially any settable binder matrix, including those formed in situ. It will be readily apparent to those of ordinary skill in the art of tool making that the procedure of the present invention is of greatest significance when the abrasive, or the binder matrix material, or both are expensive and it is desired to minimize the cost of the tool by concentrating the working abrasive at the working face of the tool, or when the configuration of the tool is complex and difficult to form by conventional molding operations customary in the art.

In the case of expensive constituents, such as diamond abrasives or the like, the present procedure facilitates concentration of the abrasive and its matrix binder at the working faces of the tool, which may thereafter be supported by a suitable, less expensive substrate formed in situ by molding in place a suitable substrate composition.

In other cases, the present procedure can materially aid in attaining improved conformity to mold surfaces, so that the resulting tool has improved definition and conformity to the desired configuration. This aspect is particularly significant to the formation of compound tool configurations having complex shapes which are difficult to form with acceptable precision by other techniques.

As will be readily apparent, centrifugal force will be most effective when the working face is aligned normal to the direction of the force, and vibratory action will be most effective when it is linear and parallel with the force of gravity and the plane of the working face is aligned normal to the direction of the linear vibratory action. For many tool configurations, such conditions will be easy to attain, but with complex tool shapes, it may be more effective to perform the tool face molding operation in a plurality of sequential stages with differing alignments of the mold in relation to the centrifugal force and/or vibratory action. While this feature adds to the complexity and expense of the tool making operation, the superior tool which results may, in appropriate circumstances prove worthwhile.

In operation, substantially any molding procedure can be employed and, if necessary, adapted to the present invention. The variables necessary or appropriate to such adaptations will, in general terms, be readily apparent to those of ordinary skill in the art.

The most common procedure, and that most readily adaptable to the centrifugal and/or vibratory casting procedure of the present invention, will be a simple molding operation which results from adding a particular abrasive and a flowable molding composition to the mold cavity under application of centrifugal force and/or vibratory action which constrains and/or sifts the abrasive particles to the working faces and which cause the molding composition to impregnate the interstices among and between the abrasive particles. Once the molding composition and abrasive particles are formed to a self-sustaining configuration in the mold, the application of centrifugal force and/or vibratory action is no longer required. This will normally require at least partial setting of a settable binder or some other equivalent result.

When the abrasive-binder formulation is formed as a thin shell within the mold, it will often be appropriate to mold in situ a substrate which supports the working face shell. The substrate may, of course, be formed of the same or different compositions, and if employed can fill the entire remaining cavity or less as may be most appropriate to the desired tool. This substrate formation may be a subsequent operation performed after the shell is fully formed or may be a continuation of the same operation as employed for formation of the shell. Although it is not required or even appropriate in most circumstances, the substrate composition may be identical to the shell composition, including the presence of abrasive particles. In more usual circumstances, the substrate core will be formed of less expensive materials.

The settable binder matrix will most conveniently be a flowable synthetic polymer composition, usually a thermosetting resin such as epoxy resin, polyurethane, or polyester, and the like. Such resin formulations are well known to those of ordinary skill in the art, and selection of an appropriate binder is not a unique feature of the present invention. Any of the usual curing systems normally employed with such resins may be employed, including thermal, chemical or radiation curing as examples.

It is also possible to employ flowable thermoplastic resin formulations in the practice of the present invention. Although such formulations are not commonly employed for such tool making operations, those of ordinary skill will recognize that there are circumstances where such tools may be desirable. Such tools may be formed using thermal molding procedures, by deposition of casting syrups (i.e., precipitation of high solids content polymer solutions) or by deposition from dispersions of the resin system in non-solvent formulations.

This also leads to the possibility of employing a multiple binder procedure wherein the abrasive grain is partially bound, e.g., on the working face, by one type of binder matrix and partially bound, e.g., on the opposed, non-working interior face by a different binder. This type of operation leads to the possibility that suitable tools formed by such a procedure might result in the exposed working surface of the abrasive being bound by a readily removable thin binder film, while unexposed, non-working portion of the particles are securely bound in a strong, durable, and non-removable binder. The thin binder-film can be a strippable film on the surface of the tool, or it can simply be readily removable by the action of the tool in use by virtue of the friability of the composition employed. Another embodiment may be the removal of the thin film by light sand blasting, thermal effects, solvation, chemical etching, or any variety of other physical and chemical techniques.

By such an expedient, the working performance of the tool can be improved by avoiding having the effectiveness of the abrasive limited by virtue of being buried in the binder matrix. When the thin film is removed, a significant, albeit small, volume of each abrasive grain is exposed and each such grain is able to perform more effective work in use, preferably, without resort to procedures such as sand blasting and chemical etching procedures to attain such a result, often at the expense of the surface integrity of the tool. The present invention will at least minimize the need for such techniques.

In still other contexts, the binder matrix may be chosen from ceramics, metals, or ceremets, for the types of utilizations where those sorts of binders are usually employed. It will ordinarily be appropriate to form such tools as self-sustaining green bodies suitable for subsequent firing operations as the most convenient technique. Such molded forms may be further treated by impregnation with fluid synthetic resins or by deposition of metals by infusion of electrical or chemical plating compositions or the like.

At its broadest, the present invention encompasses the formation of a negative image of the desired tool in a mold, followed by forming a layer of closely packed abrasive particles and a binder composition in an amount sufficient to bind the abrasives, subjecting the abrasive particles and binder to centrifugal force and/or vibratory action to conform the abrasive particles to the working surface of the mold and binding said particles by at least partially setting the binder composition while the binder and abrasive particles are conformed to said mold surface.

As is well known in the art, it is of course possible to incorporate into tools molded by the present procedure molded-in elements, such as mounting means, structural reinforcing, and the like. Such additional features may be placed as mold inserts prior to or during the molding operation.

In many circumstances, if not most, it will be appropriate to coat the surfaces of the mold with a mold release agent before use. A wide variety of such materials are well known to those of ordinary skill in the art.

While the present invention is particularly valuable in making complex tools, such as those employed in TFM cutting master fabrication or other such complex shapes, it is equally applicable to relatively simple shapes as well, and is most conveniently understood in reference to such simple tools. The invention is accordingly exemplified by the following embodiment, wherein a relatively simple rotary grinding tool is formed by the method of the present invention.

Figure 2:
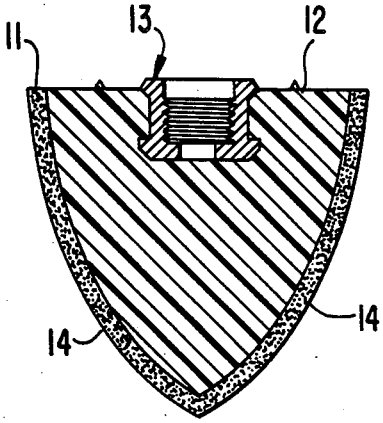
FIG. 2 shows a simple example in cross-section of an abrasive tool made in accordance with the mold shown in FIG. 1.

As shown in FIG. 1, a mold 1 is made having a cavity 2 which is a negative image of the desired tool, shown in FIG. 2. Mold 1 is adapted to generate centrifugal force , in this embodiment, by the provision of spindle 3 which can be conveniently mounted onto a rotary drive means, not shown. Mold 1 is also provided with cover 4 which is fastened in place with appropriate fastenings, shown here as machine screws 5, although any suitable means may be employed. Cover 4 is provided with air vents 6 to permit escape of air as the mold cavity is filled, and with inlet 7 through which the materials can be introduced into the mold cavity 2. In this embodiment, the inlet 7 projects into the mold cavity and is provided with a threaded portion 8 adapted to mount and secure a mold insert, as shown in FIG. 2 at reference number 13.

In a preferred operation, abrasive grains are first mixed with a two part epoxy resin outside the mold and are introduced into the mold. While it is possible to introduce these materials into the closed mold while it is rotated, it has been found that faster and more convenient operation in the instant embodiment is achieved if the mixture is "puttied" onto the mold surfaces and the mold is thereafter closed and rotated to generate centrifugal force. The epoxy resin selected is one which cures to a thermoset condition at ambient temperatures by chemical action and requires no other curing operation.

The mixture of resin and abrasive is mixed to provide a viscous, putty-like consistency which does not easily flow, even under moderate pressure. This prevents the mixture from sagging to the "low" points in the mold under the force of rotation gravity. In addition, for the mold shown in FIG. 1, when mounted solely on a vertical axis rotary drive, the centrifugal force of rotation will tend to apply a force outward normal to the axis of rotation, and in this mold will have an upward vector which is counter to gravity.

When the resin-abrasive mix is subjected solely to centrifugal force, the mixture will conform closely to the inner surfaces of the mold. The abrasive grains, having a greater density than the resin composition, will migrate to and concentrate at the mold surface and will pack together to form a substantially continuous layer at the points of contact with the mold surface. The centrifugal force is preferably maintained at least until the epoxy resin has partially cured, to the extent that the mixture will no longer flow.

Figure 3:
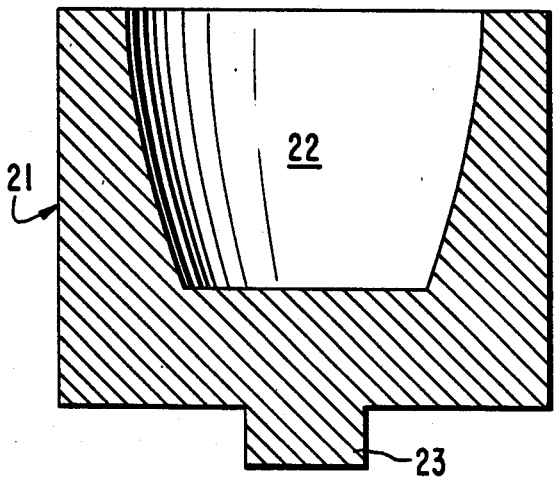
FIG. 3 shows a cross-sectional view of a tool forming mold adopted for use in imparting vibratory action according to the present invention.
Figure 4:
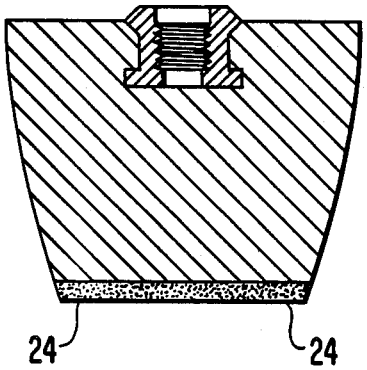
FIG. 4 shows a simple example in cross-section of an abrasive tool made in accordance with the mold shown in FIG. 3.

In FIG. 3, a mold 21 is made having a cavity 22 which is a negative image of the desired tool, shown in FIG. 4. Mold 21 is adapted to generate vibratory action, in this embodiment, by the provision of arm 23 which can be conveniently connected to vibratory drive means, not shown.

In a preferred operation, abrasive grains are first uniformly mixed with a epoxy resin composition outside the mold and are introduced into the mold. While it is possible to introduce these materials into the mold during vibratory action, it has been found that faster and more convenient operation in the instant embodiment is achieved if the mixture is "puttied" onto the mold surfaces and thereafter subjected to vibratory action. The epoxy resin selected is one which cures to a thermoset condition at ambient temperatures by chemical action and requires no other curing operation.

When the mold 21 shown in FIG. 3 is mounted on a vibratory drive, the vibratory action will tend to apply a force which is normal to the plane of the working surface. Other molds and other tool configurations may require other arrangements, of course, such being within the ordinary skill of the art.

When the resin-abrasive mix is subjected solely to vibratory action, the mixture will, as previously noted, experience accentuated gravitational force. The abrasive grains, having a greater density than the resin composition, will undergo a sifting action, through the resin composition thereby concentrating and packing together at the mold surface to form a substantially continous layer at the points of contact with the mold surface.

The resulting tool from the mold 21, shown in FIG. 3, is shown in FIG. 4. The entire working surface 24 is made up of the abrasive particulate bound in place by the epoxy resin in a close and detailed replication of the mold surface.

While the operations of rotation and vibration on the mold may be performed separately, depending on the desired result, they may also be performed simultaneously. This can be achieved by mounting the mold onto a vibratory-axial rotary drive. Further, these operations may be performed in any combination relative to each other to obtain the desired result in the working tool.

While the cure of the resin composition is still in progress, a secondary settable composition of an epoxy resin with a high loading of an inert diluent filler, for economic reasons, may be introduced under pressure into the mold cavity until the cavity is completely filled. Once the molded article is sufficiently cured to assure its structural integrity, it can be removed from the mold, but of course the resulting tool should not be used until the cure has proceeded in accordance with the dictates of the resin system, i.e., for the epoxy resin system, for at least twelve, and preferably about twenty four hours.

The resulting tool from the mold 1 shown in FIG. 1, is shown in FIG. 2, wherein the resin-abrasive layer 11 is bonded to the substrate 12, which fills the interior of the tool and bonds in place insert 13. The entire working surface 14 is made up of the abrasive particulate bound in place by the epoxy resin in a close and detailed replication of the mold surface.

For purposes of comparison, the foregoing procedures are repeated without rotating and/or vibrating the mold to produce centrifugal forces and/or vibratory action. When the resulting tools are removed and inspected, it is found that trapped air has left bubbles in the surface in places, and that the abrasive grains are not as closely packed or as concentrated at the working surface. The working surface is resin rich and the tools require substantial sand blasting, or some other treatment, to remove the cured resin from the surfaces to expose the abrasive. After sandblasting, the surfaces are irregular and do not provide a close and detailed replication of the mold surface.

What is claimed is:

1. A method of making an abrasive tool having working surfaces comprising the steps of sequentially;

A. forming a negative image of the tool in a mold,

B. placing a coating composition in the mold at regions that will become the working surfaces of the final tool, C. introducing into the mold a particulate abrasive and a first substrate which is flowable and setable, the abrasive and first substrate being provided, i. in proportional amounts wherein the first substrate at least partially impregnates the interstices of the particulate abrasive, and ii. in total amounts wherein the mixture of the first substrate and the particulate abrasive incompletely fills the mold, D. applying sufficient centrifugal force and/or vibratory action to the mold to cause, i. the first substrate to at least partially impregnate said interstices, and conform the first substrate-abrasive mixture to the shape of the mold, thus forming a first substrateabrasive shell, and ii. the abrasive to migrate through the first substrate into the coating composition, thus causing abrasive particles to be partially within said first substrate and partially within said coating composition, E. at least partially filling the mold with a second substrate whereby forming in situ a support for said shell in non-working regions of the final abrasive tool, whereby each abrasive grain is partially bound on a working surface of the tool by the binding composition and partially by the first substrate.

2. The method of claim 1, wherein said particulate abrasive and said binder composition are mixed into a uniform dispersion before being introduced into said mold.

3. The method of claim 2, wherein said uniform dispersion of particulate abrasive and binder composition is introduced into said mold in a quantity sufficient to fill the mold cavity.

4. The method of claim 1, wherein said binder composition comprises at least one member selected from the group consisting of flowable thermosetting resins, ceramics, glasses, metals and combinations thereof.

5. The method of claim 3, wherein said binder composition comprises at least one member selected from the group consisting of flowable thermosetting resins, ceramics, glasses, metals and combinations thereof.

6. The method of claim 1, wherein the abrasive is provided in an amount at least sufficient to form an essentially continuous monolayer of abrasive on the working surfaces of the final tool.

7. The method of claim 1, wherein the second substrate contains no abrasive therein.

8. The method of claim 1, wherein the second substrate completely fills the first substrate-abrasive shell.

9. The method of claim 1, wherein said first and second substrates differ in composition.

10. The method of claim 1 wherein the mold is complex and,

A. introducing into the mold a portion of the first substrate-abrasive mixture,

B. applying centrifugal force and/or vibratory action in one direction whereby a first partial shell is formed, c. introducing the balance of said mixture and applying centrifugal force and/or vibratory action in a second direction whereby a second partial shell is formed, and said first and second particle shells becoming joined to form a single, unitary shell, D. filling said single, unitary shell at least partially with a second substrate to form in situ a support for same.

11. The method of claim 1, wherein said coating composition is a readily removable film.

12. The method of claim 11, wherein said coating composition film is thin and stripable and is moved from the surface of the final tool by striping or by tool usage.

13. The method of claim 11, wherein said film is removed by light sand blasting, thermal effects, solvation, chemical etching, or other physical or chemical techniques.

* * * * *